United States Patent [19]

Sutton, III et al.

[11] 4,025,002

[45] May 24, 1977

[54] SPIRAL FOR TRAVERSING STRAND MATERIAL

[75] Inventors: John C. Sutton, III, State College, Pa.; Jerry J. Summerlin, Highpoint, N.C.

[73] Assignee: PPG Industries, Inc., Pittsburgh, Pa.

[22] Filed: Apr. 21, 1976

[21] Appl. No.: 678,853

[52] U.S. Cl. ..... 242/18 G; 242/43 R

[51] Int. Cl.[2] ..... B65H 54/28

[58] Field of Search ..... 242/18 G, 18 R, 43 R, 242/43 A, 43.2, 157 R, 157.1

[56] References Cited

UNITED STATES PATENTS

| | | | |
|---|---|---|---|
| 2,391,870 | 1/1946 | Beach | 242/43 R |
| 3,040,999 | 6/1962 | Hayden et al. | 242/43 R |
| 3,056,711 | 10/1962 | Frickert | 242/18 G |
| 3,198,444 | 8/1965 | Moody et al. | 242/18 G |
| 3,292,872 | 12/1966 | Hayden | 242/43 R |
| 3,356,304 | 12/1967 | Genson | 242/43 R X |
| 3,414,956 | 12/1968 | Genson | 242/18 G X |
| 3,784,121 | 1/1974 | Arno et al. | 242/43 R |
| 3,861,608 | 1/1975 | Mohr et al. | 242/43 R |

*Primary Examiner*—John Petrakes
*Attorney, Agent, or Firm*—Alan T. McDonald; John E. Curley

[57] ABSTRACT

A novel spiral for the traversing of strand material, andespecially glass strands, during winding of the strands onto a mandrel is disclosed. The spiral includes a third wing which, when the direction of travel of the spiral is reversed, permits strand to be wound on an edge of the mandrel during a call down and before the winder is stopped. Alternatively, the novel spiral may be employed to form a tie-on-tail of strand during winding of a forming package.

10 Claims, 4 Drawing Figures

SPIRAL FOR TRAVERSING STRAND MATERIAL

BACKGROUND OF THE INVENTION

In the formation of thermoplastic fibers, the fibers are typically wound onto a forming package carried on the surface of a rotating mandrel or collet. The collet is rotated by a motorized winder which may be separate from or incorporated into the collet itself. In the case of glass fibers, filaments are attenuated through bushing tips in a bushing, coated with an aqueous binder and/or size, gathered into a unified strand, and wound onto the forming package. In addition to collecting the formed fiber strands, the forming package rotating on the collet supplies the attenuation forces necessary to draw the glass filaments from the bushing. The completed forming packages are then used in numerous industrial operations, for example, to form twisted textile yarn, tire cord, glass fiber roving and the like.

In operations such as the formation of tire cord and glass fiber roving it is often desirable to form a finished product having a length longer than that provided by the strands contained on a single forming package. To accomplish this, the ends of individual packages must be connected. Glass strand can be unwound from a forming package either from the outside or the inside. In either case, difficulties arise when a multiplicity of forming packages must be connected to one another.

When glass strand is unwound from the outside of a forming package, the strand is unwound until no strand remains. A problem with employing this method of unwinding is that the innermost strand typically has areas of excess coating and/or inconsistent diameter. The first problem is due to the tendency of the lubricant binder and/or size to migrate from the center of the package to the outer and inner layers during drying of the forming packages. Drying of forming packages is conventionally carried out in ovens to remove excess moisture present after the forming package is prepared. The second problem results from the variation in speed of the collet during start-up of the forming process. The same binder migration and inconsistent diameter problems on the outside of the package are often eliminated during end finding prior to using the forming package in a desired secondary operation such as twisting. Thus, prior to using a forming package, the package is end found by an operator so that it is certain that the strand entering a subsequent operation has all of its filaments. This procedure eliminates the outermost strand, which often has excess coating thereon caused by binder and/or size migration during drying and inconsistent diameter due to the slow-down and stopping action at the end of package formation.

Similar problems result when glass strand is unwound from a forming package from the inside. In this situation, the end finding process eliminates the excessively coated and inconsistent diameter strand from the inner portion of the package, however, now there is excessively coated and inconsistent diameter strand on the outer portion of the package. In addition to these problems, when strand is unwound from the inside, the only support that the forming package has is the outer strand. As the forming package nears its end there is less and less strand to support the remaining package. When support can no longer be maintained by the amount of strand remaining, the forming package collapses into a "bird's nest." Strand cannot be unwound from such a tangled situation and breakage of strand results. This results in a stoppage in what is desired to be a continuous process which, of course, adversely effects production.

In copending U.S. application Ser. No. 650,327 of David H. Griffiths, filed Jan. 19, 1976, now abandoned, and assigned to the assignee of the present invention, which is incorporated herein by reference, a forming package which is free of the problems typically encountered with forming packages, namely, a package which does not collapse when the strand is unwound from the inside of a package and which can be connected to a plurality of packages without the necessity of using excessively coated or inconsistent diameter strand is disclosed. The forming package includes a tie-on-tail which can be located either near the inside or near the outside end of the forming package. This tail provides a location for connecting a plurality of forming packages together without the necessity of connecting the very ends of the package to another package. When the tie-on-tail is located near the inside end of the package, such a package is used for unwinding strand from the outside. Thus, the tail eliminates the necessity of using inconsistent innermost strand of the package. When the tail is located near the outside of the package, the package is unwound from the inside. This eliminates the necessity of using the inconsistent outermost portion of the package and eliminates the collapse of the package and the resulting "bird's nest."

The apparatus employed includes an arm which has been timed to pull the strand out of the spiral over which it traverses at a desired time and to wind the tie-on-tail at an edge, preferably the inside edge, of the forming tube on which the forming package is wound at a desired time during the winding of the forming package. Such an operation requires an arm for removing the strand from the spiral, and apparatus connected to and timed with the winder to rotate the arm which pulls the strand out of the spiral.

It is desirable, therefore, to produce forming packages having a tie-on-tail thereon without the necessity of such additional apparatus.

In other glass fiber products, a tie-on-tail is not necessary, such as in forming packages of textile strand. These packages are transferred to a twist frame and twisted into yarn onto bobbins. Here, individual forming packages are employed without typing a plurality of packages together, as this process is not continuous.

In such applications, binder migration is also less of a problem, an entirely different type of binder and/or size being employed. The main problem of this type of package formation is the inconsistent strand which is wound at the very outer end of the package during slow-down and stoppage of the collet after a call down, the completion of a package.

It would be desirable, therefore, to isolate this inconsistent strand from the balance of the forming package.

THE PRESENT INVENTION

By means of the present invention, a spiral for traversing the strand during winding contains a third wing which, upon reversing the direction of rotation of the spiral, pulls the strand to an edge of the collet and winds either a tie-on-tail of strand on the edge of the forming tube or winds the inconsistent strand after a call down on an edge of the forming tube. Upon again reversing the direction of rotation of the spiral for tie-on-tail formation, the strand again reverses in the spiral and is wound on the forming package.

Thus, when it is desired to form the tie-on-tail near the inside of the package, so that the inconsistent innermost strand of the completed forming package may be discarded when the strand is drawn from the outside and only the consistent strand is used in a subsequent process, the initial strand is wound on an edge of the forming tube.

The inconsistent innermost strand of the forming package is wound around the majority of the forming tube, the spiral is reversed in its direction of rotation, forming the tie-on-tail on an edge of the forming tube, the spiral is again reversed in its direction of rotation and the balance of the strand is wound on top of the innermost strand on the forming package. The innermost strand which has excess binder due to the migration caused by drying and an inconsistent diameter due to start-up will then be discarded during the connection of the subsequent forming package and the outermost strand which has excess binder will be eliminated by end finding.

When it is desired to form the tie-on-tail near the outside of the package, so that the inconsistent outermost strand of the completed forming package may be discarded when the strand is drawn from the inside and only the consistent strand is used in a subsequent process, the initial strand is wound on an edge of the forming tube.

The strand is then wound around the majority of the forming tube, the spiral is reversed in its direction of rotation, forming the tie-on-tail on an edge of the forming tube, the spiral is again reversed in its direction of rotation, and the inconsistent outermost strand is wound on top of the forming package. The outermost strand which has excess binder due to migration and inconsistent diameter due to slow-down and stopping will then be discarded during the connection of subsequent forming packages and the innermost strand which has excess binder will be eliminated by end finding.

Such a method of forming a tie-on-tail within a forming package of strand material eliminates the necessity of separate apparatus for physically removing the strand from the spiral which must be connected to and timed with the action of the winder.

When a tie-on-tail is unnecessary and it is desired to isolate the inconsistent strand at the end of a production run or a call down, the spiral is reversed at the point of the completion of the call down, to wind the inconsistent strand at the edge of the forming package. In this embodiment, the strand is peferably wound on top of the inconsistent strand wound at the beginning of formation of the forming package. A "call down" is the completion of a winding operation signaled by the winding of the desired weight or length of strand on the forming tube.

DETAILED DESCRIPTION OF THE PREFERRED EMBODIMENT

Figure 1:
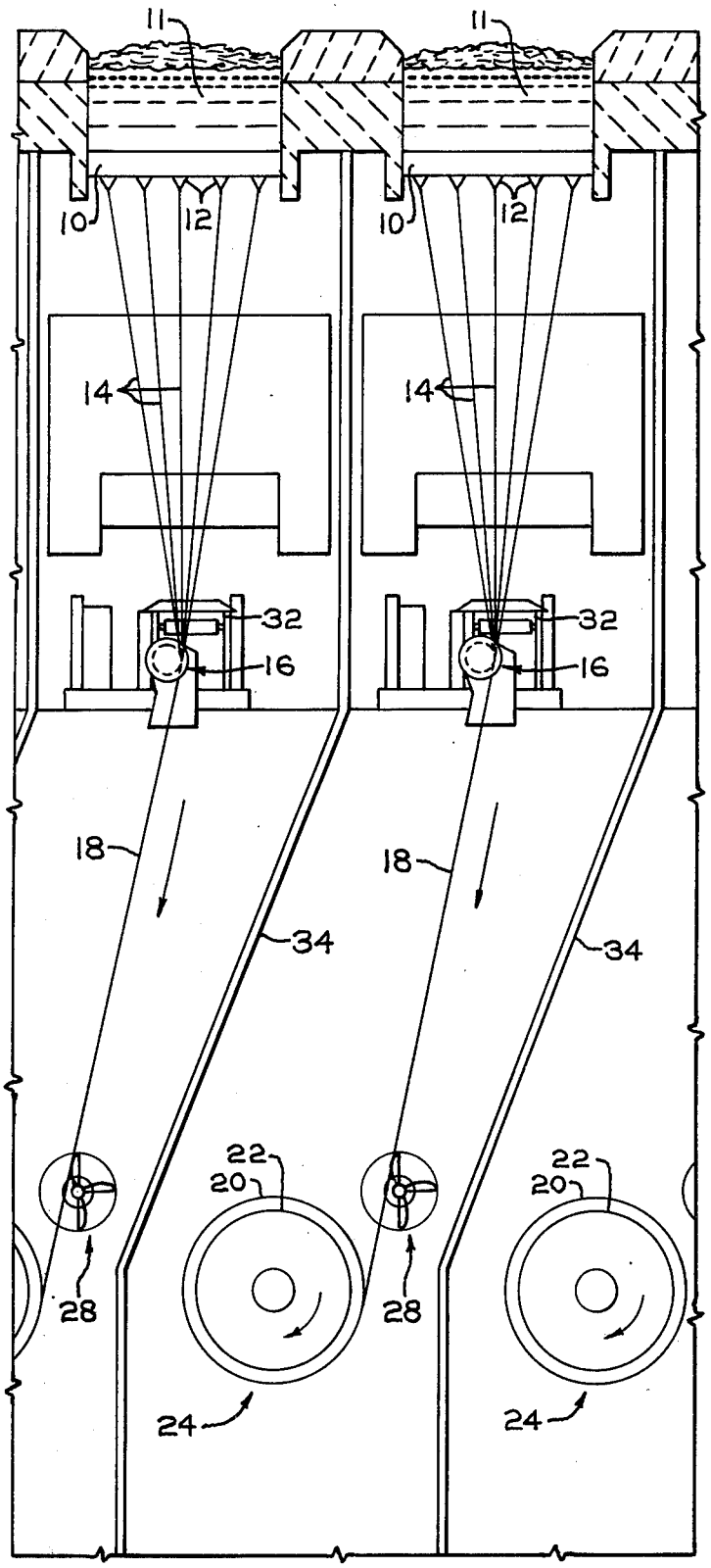
FIG. 1 diagrammatically illustrates the winding of a forming package of glass strand including the spiral of the present invention.

Turning to FIG. 1, molten glas 11 is shown contained in a bushing 10 having bushing tips 12. Glass filaments 14 are attenuated through the bushing tips 12. These filaments 14 are drawn across an applicator 32 where they are coated with an aqueous binder and/or size. In FIG. 1, the applicator is illustrated as a roller applicator, however, it will be obvious that other applicators such as belt applicators and the like could be substituted therefor. The filaments 14 pass from the applicator 32 and are gathered into a unified strand 18 by a gathering shoe 16. This shoe 16 is typically a grooved cylindrical element formed of a material such as graphite. The strand 18 passes across the spiral 28 of the present invention and is wound as a forming package 20 on a collet 22 carried by a winder 24.

Figure 2:
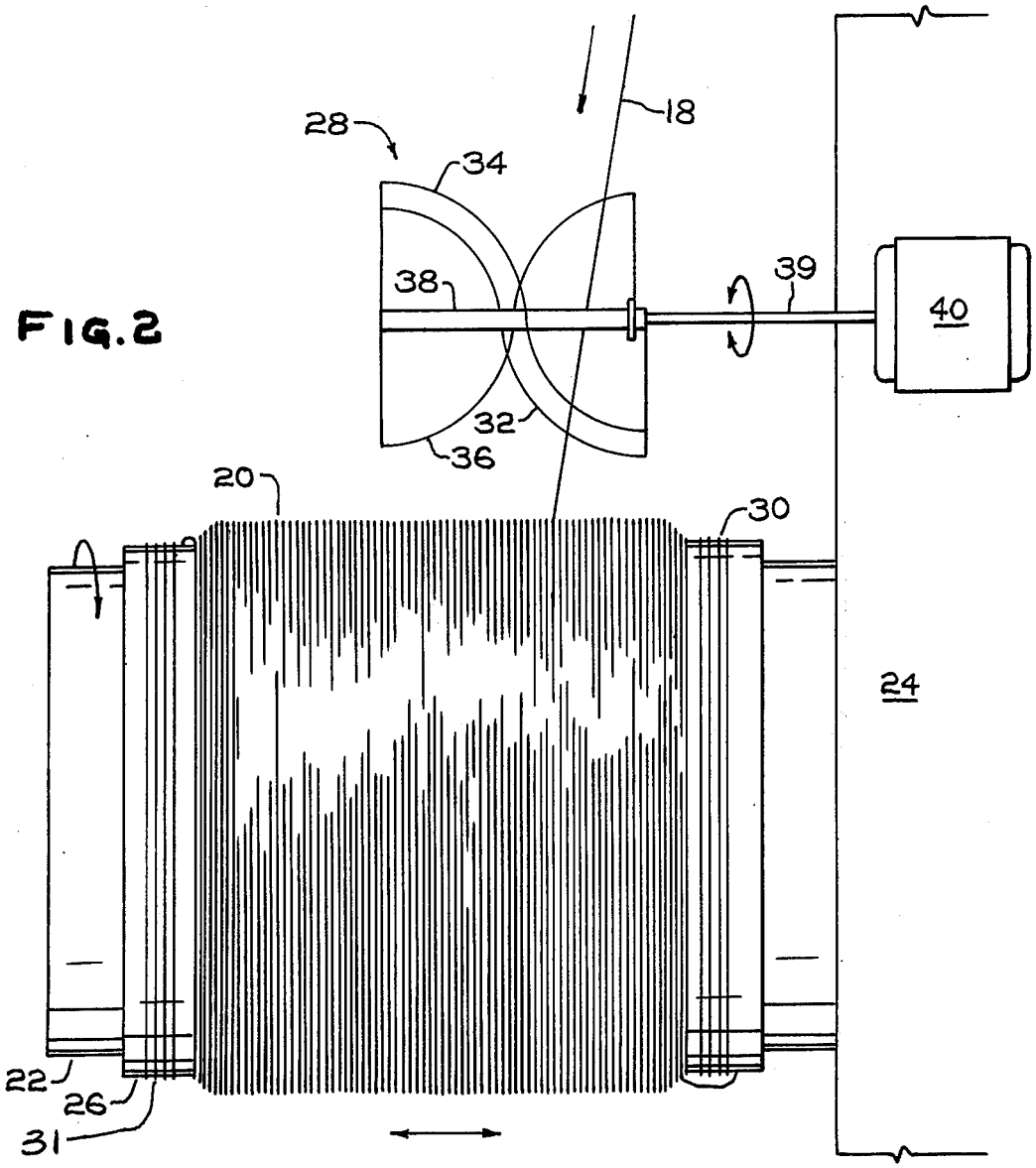
FIG. 2 illustrates the relation between the spiral and the collet and the formation of a tie-on-tail in accordance with the present invention.

As can best be seen in FIG. 2, the forming package 20 is usually formed on a forming tube 26 carried on the collet 22, hoever, the forming tube 26 is not always necessary. During start-up, initial strand 18 is wound as a band 31 on an edge of the forming tube 26. This strand has inconsistent diameter due to the start-up procedure, i.e., the winder accelerating to its normal drawing speed. Prior to the collet 22 reaching its full speed or after the collet 22 attains its full speed, the strand 18 is placed in the spiral 28. The collet 22 and the spiral 28 are then rotated, the spiral preferably in a counter clockwise direction and the collet preferably in a clockwise direction while the collet 22 reciprocates along its axis to and from the body of the winder 24. The spiral is rotated by a motor 40, such as a reversible electric motor, connected to its shaft 39. These actions form the forming package 20 on the forming tube 26 in a manner common in the art. During this time the strand 18 is traversed by the spiral 28, being thrown back and forth along the face of the spiral 28 by the action of wings 32 and 34.

In the embodiment of the instant invention where it is desired to form a tie-on-tail 30 at the edge of the forming tube 26, the spiral is reversed in its direction of rotation such that its rotation is now preferably clockwise at the time tie-on-tail formation is desired. The strand 18 is then picked up by the third wing 36 of the spiral 28 and it is held in position for the tie-on-tail 30 to be wound at an edge of the forming tube 26 by a guide 37. The direction of travel of the spiral 28 is then again reversed back to a counter clockwise direction to resume winding of the forming package 20. This is, of course, necessary if the tie-on-tail 30 is located near the inside end of the forming package in order that a complete forming package 20 may be formed. It is, however, also desirable to return the strand 18 to the forming package 20 if the tie-on-tail 30 has been formed near the outside end of the forming package 20 so that the inconsistent strand 18 formed during slow-down and stoppage of the collet 22 may be collected on the outside of the forming package 20. This enables the poor quality strand to be used to absorb migrated binder from the center of the forming package 20 so that no high quality strand need be wasted. Preferably, the spiral illustrated in FIG. 3 and more fully described below is employed in this embodiment.

In an alternative embodiment of the instant invention for isolating inconsistent strand after a call down, the spiral 28 is reversed only once. After the call down is completed and before inconsistent strand is being wound during slow-down and stoppage, the spiral is reversed on its direction of rotation to wind the inconsistent strand on an edge of the forming tube 26. Preferably, the spiral illustrated in FIG. 4, and more fully described below, is employed to wind the strand onto outer edge on top of the band 16 of strand 18 wound during start-up.

Figure 3:
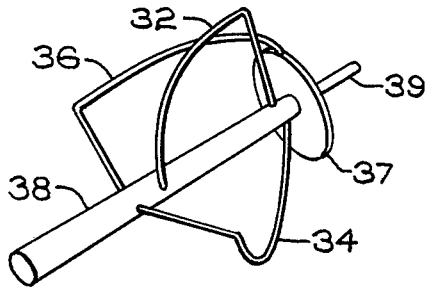

FIG. 3 is a view of the embodiment of the spiral 28. The spiral shown therein has three winds 32, 34, and 36 and a guide 37. The wings 32 and 34 act together during the counter clockwise rotation of the spiral in a manner as is common in the glass fiber forming art such that the strand 18 traverses back and forth across the length of the spiral 28 alternatively riding on the wings 32 and 34.

Wing 36 is designed such that when the spiral 28 is reversed in its direction of rotation such that the spiral 28 rotates in the clockwise direction the strand 18 is caught up by the third wing 36 of the spiral 28 and is held in a position by the guide 37 to enable the tie-on-tail 30 to be wound on the edge of the forming tube 26. Upon again reversing the direction of rotation of the spiral 28 the strand 18 is again traversed by the wings 32 and 34.

The spiral 28 may be formed of any material commonly employed for spirals. A particularly effective material is brass.

The spiral 28 can be timed to reverse its direction of rotation at any point desired by appropriate signals to the motor 40 such that the tie-on-tail 30 can be formed near the beginning, near the end, or at any other desired location in the winding cycle.

Figure 4:
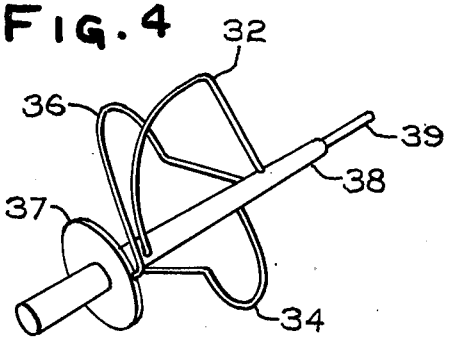
FIGS. 3 and 4 illustrate the three-winged spirals employed in the present invention.

FIG. 4 illustrates another embodiment of the spiral 28 of the present invention. In this embodiment, the third wing 36 and guide 37 are rotated 180° from the location on spiral in FIG. 3. Here the third wing 36 and guide 37 will locate the tail 30 on the outside edge of the forming package on top of the initial band 16 of strand 18. This embodiment has particular utility when the tail 30 is to be wound at the very end of the forming package 20 during slow-down and stopping of the collet 22 after a call down. Such a tail would not be employed in a tie-on-tail procedure, but would be merely discarded as waste material.

From the foregoing it can be seen that the present invention provides a simple apparatus for adding a tie-on-tail to a forming package of strand material or for isolating inconsistent strand from the balance of a forming package during a call down.

While the present invention has been described with reference to specific embodiments thereof, it is not intended to be so limited, except as set forth in the accompanying claims.

We claim:

1. A spiral for traversing strand material being wound on a surface, said spiral having three wings, the first and second wings cooperating to traverse strand across said spiral as said spiral is rotated in a given direction, the third wing cooperating with said first and second wings so that upon reversing the direction of rotation of the spiral said third wing locates strand in a position to wind strand on an edge of a surface on which said strand is being wound and a guide on said spiral connected to said third wing to hold said strand in said position during said winding on said edge.

2. The apparatus of claim 1 wherein said first and said second wings traverse said strand when said spiral is rotated in the counter clockwise direction and said third wing and said guide act upon said strand when said spiral is rotated in the clockwise direction.

3. The apparatus of claim 1 wherein said spiral is formed of brass.

4. The apparatus of claim 1 wherein said third wing locates said strand on the inside edge of said surface.

5. The apparatus of claim 1 wherein said wing locates said strand on the outside edge of said surface.

6. In an apparatus comprising a bushing having a plurality of bushing tips through which glass filaments are attenuated, an applicator for applying an aqueous binder and/or size to said filaments, a gathering shoe for gathering said filaments into a unified strand, a spiral for traversing said strand across the face of a rotating collet, reversible rotating means for rotating said spiral, and a means for collecting said wound strand into a forming package on said collet the improvement wherein said spiral has three wings, the first and second wings of which traverse said strand across said spiral as said spiral is rotated and the third wing of which locates said strand in a position to wind said strand on an edge of said colleting means upon reversing the direction of rotation of said spiral, and a guide means on said spiral to hold said strand in said position during said winding on said edge.

7. The apparatus of claim 6 wherein said first and said second wings traverse said strand as said spiral is rotated in a counter clockwise direction and said third wing and guide act upon said strand as said spiral is rotated in the clockwise direction.

8. The apparatus of claim 6 wherein said spiral is formed of brass.

9. The apparatus of claim 6 wherein said third wing locates said strand on the inside edge of said collet.

10. The apparatus of claim 6 wherein said third wing locates said strand on the outside edge of said collet.

* * * * *